US009949586B2

(12) United States Patent
Bennett

(10) Patent No.: US 9,949,586 B2
(45) Date of Patent: Apr. 24, 2018

(54) ACCESSORIES RACK

(71) Applicant: Erith Bennett, Fayetteville, GA (US)

(72) Inventor: Erith Bennett, Fayetteville, GA (US)

( * ) Notice: Subject to any disclaimer, the term of this patent is extended or adjusted under 35 U.S.C. 154(b) by 0 days.

(21) Appl. No.: 14/724,551

(22) Filed: May 28, 2015

(65) Prior Publication Data

US 2015/0359369 A1 Dec. 17, 2015

Related U.S. Application Data

(60) Provisional application No. 62/011,575, filed on Jun. 13, 2014.

(51) Int. Cl.
*A41D 27/22* (2006.01)
*A47G 25/74* (2006.01)

(52) U.S. Cl.
CPC ..... *A47G 25/743* (2013.01); *A47G 2200/143* (2013.01)

(58) Field of Classification Search
CPC ..... A47G 25/74; A47G 25/746; A47G 25/18; A47G 25/183; A47G 25/186
USPC ..... 223/DIG. 1
See application file for complete search history.

(56) References Cited

U.S. PATENT DOCUMENTS 2,162,919 A * 6/1939 McAuliffe ..... A47F 7/24 211/96
2,593,356 A * 4/1952 Smith ..... A47G 25/18 211/119
3,202,297 A * 8/1965 Hardy ..... A47F 5/04 211/163
3,945,500 A * 3/1976 Meckstroth ..... A47G 25/743 211/113
4,058,222 A * 11/1977 Singer ..... A47G 25/18 211/118
4,196,813 A * 4/1980 Cohen ..... A47F 7/24 211/168
4,434,897 A * 3/1984 Gelhaus ..... D06F 57/12 211/1.3
5,797,527 A * 8/1998 Lam ..... A47G 25/0607 223/85
5,809,470 A * 9/1998 Monjo ..... G06K 19/04 223/85
5,901,888 A * 5/1999 Schneider ..... A47G 25/403 223/88
6,196,396 B1 * 3/2001 Bennett ..... A47F 7/12 211/113
2002/0033403 A1 * 3/2002 Bennett ..... A47F 7/12 223/87

(Continued)

*Primary Examiner* — Nathan Durham

(57) ABSTRACT

Implementations of an accessories rack are provided. In some implementations, the accessories rack may comprise a first stem connecting a first support base and a second support base, a hook connected to the top of the first support base, and a second stem connected to the bottom of the second support base. The accessories rack further may comprise a first pair of divergent set of steps wherein each set of steps of the first pair is rotatably connected to the bottom of the first support base and extend away from a portion of the first stem. The accessories rack further may comprise a second pair of divergent set of steps wherein each set of steps of the second pair are rotatably connected to the second support base and extend away from a portion of the second stem.

9 Claims, 1 Drawing Sheet

(56) References Cited

U.S. PATENT DOCUMENTS

2006/0226179 A1* 10/2006 Hsu ..... A47G 25/743
223/85

* cited by examiner

ACCESSORIES RACK

CROSS REFERENCE TO RELATED APPLICATION

This application claims the benefit of U.S. patent application Ser. No. 62/011,575, which was filed on Jun. 13, 2014, and is incorporated herein by reference in its entirety.

TECHNICAL FIELD

This disclosure relates to implementations of an accessories rack.

BACKGROUND

U.S. Pat. No. 6,398,086 ('086 patent), which was filed on Jan. 11, 2001, and is incorporated herein by reference in its entirety, discloses racks for supporting apparel accessories such as ties, belts, and scarfs. The racks disclosed in the '086 patent are a single integrated piece formed from injection molded thermosetting plastic. Furthermore, the steps of the racks of the '086 patent are stationary. Still further, for the implementations of the racks of the '086 patent having a downwardly divergent set of steps at the base of the rack, the set of steps are connected by a bridge and horizontal base.

DETAILED DESCRIPTION

Figure 1:
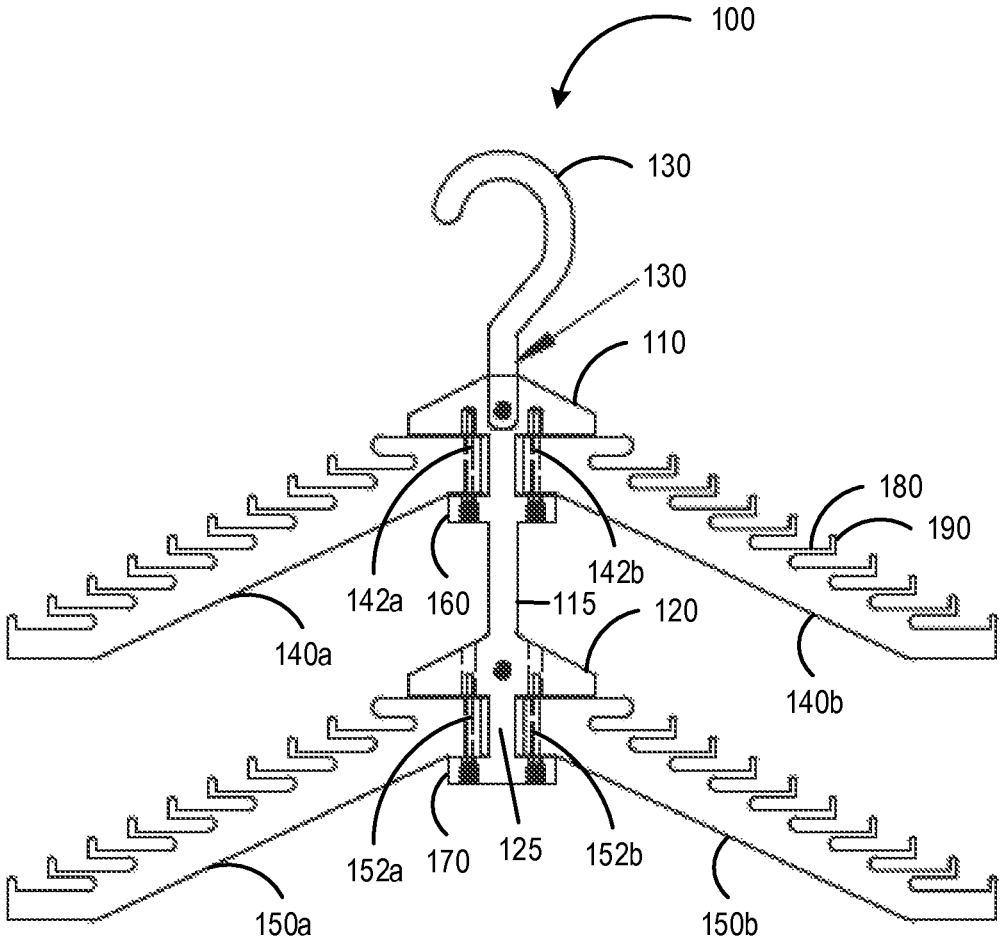
FIG. 1 illustrates an example implementation of an accessories rack according to the principles of the present disclosure.

Implementations of an accessories rack are provided. In some implementations, the accessories rack may comprise a first stem connecting a first support base and a second support base, a hook connected to the top of the first support base, and a second stem connected to the bottom of the second support base. The accessories rack further may comprise a first pair of divergent set of steps wherein each set of steps of the first pair is rotatably connected to the bottom of the first support base and extend away from a portion of the first stem. The accessories rack further may comprise a second pair of divergent set of steps wherein each set of steps of the second pair are rotatably connected to the second support base and extend away from a portion of the second stem.

FIG. 1 illustrates an example implementation of an accessories rack 100 according to the principles of the present disclosure. In some implementations, the accessories rack 100 may comprise a first stem 115 connecting a first support base 110 and a second support base 120, a hook 130 connected to a portion of the first support base 110, and a second stem 125 connected to the bottom of the second support base 120. In some implementations, the accessories rack 100 further includes a first pair 140 of downwardly divergent set of steps 140*a*, 140*b* rotatably connected to the bottom of the first support base 110 and extending downwardly and away from a portion of the first stem 115, and a second pair 150 of downwardly divergent set of steps 150*a*, 150*b* rotatably connected to the second support base 120 and extending downwardly and away from a portion of the second stem 125.

In some implementations, the accessories rack 100 includes a first pair of upwardly divergent set of steps (similar to the steps in FIG. 5 and FIG. 9 of the '086 patent) rotatably connected to the bottom of the first support base 110 and extending upwardly and away from a portion of the first stem 115, and a second pair of upwardly divergent set of steps (similar to the steps in FIG. 5 and FIG. 9 of the '086 patent) rotatably connected to the second support base 120 and extending upwardly and away from a portion of the second stem 125.

In some implementations the hook 130 may be configured to be detachable from the first support base 110. In some implementations, the first support base 110 may include a groove configured to fit an end of the hook therein. In some implementations, the hook 130 may be configured to be detachable from the first support base 110 in other suitable manner. One of ordinary skill in the art with the benefit of this disclosure would know how to make the hook 130 detachable from the first support base 110.

In some implementations, each step of the first and second pair of downwardly divergent steps include a horizontal portion 180 extending away from the first and second stem and a vertical portion 190 extending upward from the end of the horizontal portion.

In some implementations, the set of steps 140*a*, 140*b* are separate parts connected to the first support base 110. In some implementations, the set of steps 150*a*, 150*b* are separate parts connected to the second support base 120.

In some implementations, the first pair 140 of downwardly divergent steps 140*a*, 140*b* are rotatably connected to the bottom of the first support base 110 with dowels 142*a*, 142*b* extending through a portion of the first support base 110 and the steps 140*a*, 140*b*, respectively. In this way, the steps 140*a*, 140*b* are independently rotatable. In some implementations, the dowels 142*a*, 142*b* may extend from the first support base 110 through the steps to a platform 160 extending from the first support stem 115 upon which the steps 140*a*, 140*b* may rest. In some implementation, the dowels 142*a*, 142*b* may be held in place by screws inserted in the bottom of the platform 160.

Similarly, in some implementations, the second set of downwardly divergent steps 150*a*, 150*b* (collectively 150) are rotatably connected to the bottom of the second support base 120 with dowels 152*a*, 152*b* extending through a portion of the second support base 120 and the steps 150*a*, 150*b*, respectively. In this way, the steps 150*a*, 150*b* are independently rotatable. In some implementations, the dowels 152*a*, 152*b* may extend from the second support base 120 through the steps to a platform 170 extending from the second support stem 125 upon which the steps 150*a*, 150*b* may rest. In some implementation, the dowels 152*a*, 152*b* may be held in place by screws inserted in the bottom of the platform 170.

Thus, in some implementations, the steps 140*a*, 140*b*, 150*a*, and 15*b* are independently rotatable.

In some implementations the first and second set of downwardly divergent steps may be rotatably connected to the first and second support base, respectively, by any other suitable means.

In some implementations, the rack may include circuitry and/or other hardware configured to make a sound or play a pre-recorded message when an accessory is removed therefrom.

Reference throughout this specification to "an embodiment" or "an implementation" or words of similar import means that a particular described feature, structure, or characteristic is included in at least one embodiment of the present invention. Thus, the phrase "in an embodiment" or "an implementation" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

The invention claimed is:

1. A rack comprising:

a first stem extending in a vertical direction connecting a first support base and a second support base wherein the first stem, the first support base and the second support base are vertically aligned along a common axis;

a hook connected to a portion of the first support base;

a second stem extending in a vertical direction connected to the bottom and center of the second support base;

the first stem and the second stem each have a horizontal width less than a horizontal width of each of the first support base and the second support base;

a first pair of divergent set of steps wherein each set of steps of the first pair is rotatably connected to the bottom of the first support base and extend away from a portion of the first stem; and a second pair of divergent set of steps wherein each set of steps of the second pair are rotatably connected to the second support base and extend away from a portion of the second stem, wherein each set of steps of the first pair and second pair of divergent set of steps are configured to rotate around a vertical axis such that the height of the set of steps with respect to the rack does not change as the set of step is rotated.

2. The rack of claim 1 wherein the first pair of divergent set of steps is downwardly divergent such that each set of steps of the first pair extend downwardly and away from a portion of the first stem and wherein the second pair of divergent set of steps is downwardly divergent such that each set of steps of the second pair extend downwardly and away from a portion of the second stem.

3. The rack of claim 1 wherein the hook is configured to be detachable from the first support base.

4. The rack of claim 1 wherein each step of the set of steps include a horizontal portion extending away from the first or second stem and a vertical portion extending upward from the end of the horizontal portion.

5. The rack of claim 1 wherein the set of steps of the first pair are separate parts connected to the first support base.

6. The rack of claim 5 wherein the set of steps of the second pair are separate parts connected to the second support base.

7. The rack of claim 1 wherein each set of steps of the first pair is rotatably connected to the bottom of the first support base with a dowel extending through at least a portion of the first support base and at least a portion of the steps.

8. The rack of claim 7 wherein each set of steps of the second pair is rotatably connected to the bottom of the second support base with a dowel extending through at least a portion of the second support base and at least a portion of the steps.

9. The rack of claim 8 further comprising a first platform extending from the first support stem upon which a portion of the steps of the first pair rest and a second platform extending from the second support stem upon which a portion of the steps of the second pair rest wherein each set of steps of the first pair is rotatably connected to the bottom of the first support base with a dowel extending from the first support base and through the steps to the first platform and wherein each set of steps of the second pair is rotatably connected to the bottom of the second support base with a dowel extending from the second support base and through the steps to the second platform.

* * * * *